US011075483B2

(12) United States Patent
Lai et al.

(10) Patent No.: US 11,075,483 B2
(45) Date of Patent: Jul. 27, 2021

(54) ELECTRONIC CONNECTOR

(71) Applicant: AVERTRONICS INC., Taichung (TW)

(72) Inventors: Austin Lai, Taichung (TW); Chi-I Lai, Taichung (TW); Chung-Jen Chang, Taichung (TW)

(73) Assignee: AVERTRONICS INC., Taichung (TW)

( * ) Notice: Subject to any disclaimer, the term of this patent is extended or adjusted under 35 U.S.C. 154(b) by 0 days.

(21) Appl. No.: 16/835,111

(22) Filed: Mar. 30, 2020

(65) Prior Publication Data

US 2021/0057846 A1 Feb. 25, 2021

(30) Foreign Application Priority Data

Aug. 22, 2019 (TW) ..... 108211171

(51) Int. Cl.
*H01R 13/533* (2006.01)
*H01R 13/631* (2006.01)
*H01R 4/18* (2006.01)
*H01R 13/52* (2006.01)

(52) U.S. Cl.
CPC ..... *H01R 13/533* (2013.01); *H01R 4/183* (2013.01); *H01R 13/5219* (2013.01); *H01R 13/631* (2013.01); *H01R 2201/26* (2013.01)

(58) Field of Classification Search
CPC ..... H01R 13/5219; H01R 13/5202; H01R 13/533; H01R 13/631; H01R 4/183; H01R 2201/26
USPC ..... 439/271
See application file for complete search history.

(56) References Cited

U.S. PATENT DOCUMENTS

2001/0023143 A1* 9/2001 Middlehurst ..... H01R 12/716 439/79
2002/0127895 A1* 9/2002 Schnatwinkel ..... H01R 9/2658 439/76.1
2003/0219999 A1* 11/2003 Minich ..... H01R 12/724 439/79
2013/0137313 A1* 5/2013 Casses ..... H01R 13/62 439/851
2016/0118744 A1* 4/2016 Wittrock ..... H01R 13/5227 439/191
2018/0269619 A1* 9/2018 Beimdieck ..... H01R 13/512
2018/0333867 A1* 11/2018 Lee ..... B25J 19/0029
(Continued)

*Primary Examiner* — Gary F Paumen

(57) ABSTRACT

An electric connector structure has a male connecting member and a female connecting member. The maximum swing and vibration space is provided between the male connecting member and the female connecting member, and then the pressure is locally compressed through the pressing face and the blocking face. The protrusion partially interferes with the power socket, thereby forming a three-point hard contact inside the male connecting member and the female connecting member, so that the male connecting member and the female connecting member can be formed at the three-point hard contact position. The limit of vibration or swing, thereby effectively reducing the amplitude of the swing or vibration of the male connecting member and the female connecting member without completely preventing the swing or vibration of the male connecting member and the female connecting member, so as to eliminate the external forces and achieve protection of the signal pin.

10 Claims, 8 Drawing Sheets

(56) References Cited

U.S. PATENT DOCUMENTS

| | | | | |
|---|---|---|---|---|
| 2019/0027855 | A1* | 1/2019 | Dai | H01R 13/665 |
| 2020/0163658 | A1* | 5/2020 | Krinninger | A61B 90/50 |

* cited by examiner

A-A

ELECTRONIC CONNECTOR

BACKGROUND OF INVENTION

Field of Invention

The present invention relates to an electronic connector, and more particularly to an electronic connector capable of absorbing external vibration.

Description of the Related Art

Accordingly, conventional electronic connectors used in electronic signals and power supplies provide electrical connections for various electronic devices, so that signals can be accurately transmitted in the operation equipment. In the electric vehicle industry, the connectors are used for connecting the battery which is an extremely important component, and both of the power motor and the signal transmission need to maintain a stable connection. However, there are still some shortcomings in the conventional structure as follows: When electric vehicles are on the road, they often shake or vibrate constantly due to uneven road surfaces, starting acceleration or braking deceleration, which may cause vibration or shaking at both ends of the connector, resulting the signal pin of the connector may being broken. In order to reduce this situation, many manufacturer reduces the gap between the male and female connectors. Although the method can eliminate vibration of the connector, it also results in the tolerance is too small for high yield rate, therefore the male and female connectors are not easy to mating which is a new tech issue.

Therefore, it is desirable to provide an electronic connector capable of absorbing external shock to mitigate and/or obviate the aforementioned problems.

SUMMARY OF THE INVENTION

An objective of present invention is to provide an electronic connector, which is capable of improving the above-mention problems.

In order to achieve the above mentioned objective, an electronic connector has:

a male connecting member having a collar jacketed with an elastic loop and provided with a first inner sidewall, the male connecting member further having a signal unit and a spacer in the collar arranged in a T-shape; the signal unit provided with a plurality of signal pins; the male connecting member having two elastic power poles separated by the spacer; the signal unit having a protrusion facing the two elastic power poles and the spacer having a pressing face facing the signal pins;

a female connecting member having an outer ring with a second inner sidewall, the outer ring further having a signal socket and two power sockets, the signal socket having an elastic signal beam tube, each of the power sockets having a power connecting tube, the signal socket and the power socket not connected to the second inner sidewall, a ducking slot disposed between the two power sockets, the signal socket having a blocking face towards the ducking slot; the collar of the male connecting member insertable into the outer ring of the female connecting member, the signal socket and the power socket disposed inside of the collar, the signal pin and the elastic power pole respectively insertable into the elastic signal beam tube and the power connecting tube; the first inner sidewall of the collar making no contact with the signal socket and the power socket; the second inner sidewall of the outer ring only making contact with the elastic loop; a portion of the protrusion of the signal unit making contact with the power socket, a portion of the pressing face of the spacer pressing the blocking face of the signal socket.

Other objects, advantages, and novel features of invention will become more apparent from the following detailed description when taken in conjunction with the accompanying drawings.

DETAILED DESCRIPTION OF THE PREFERRED EMBODIMENT

Figure 1:
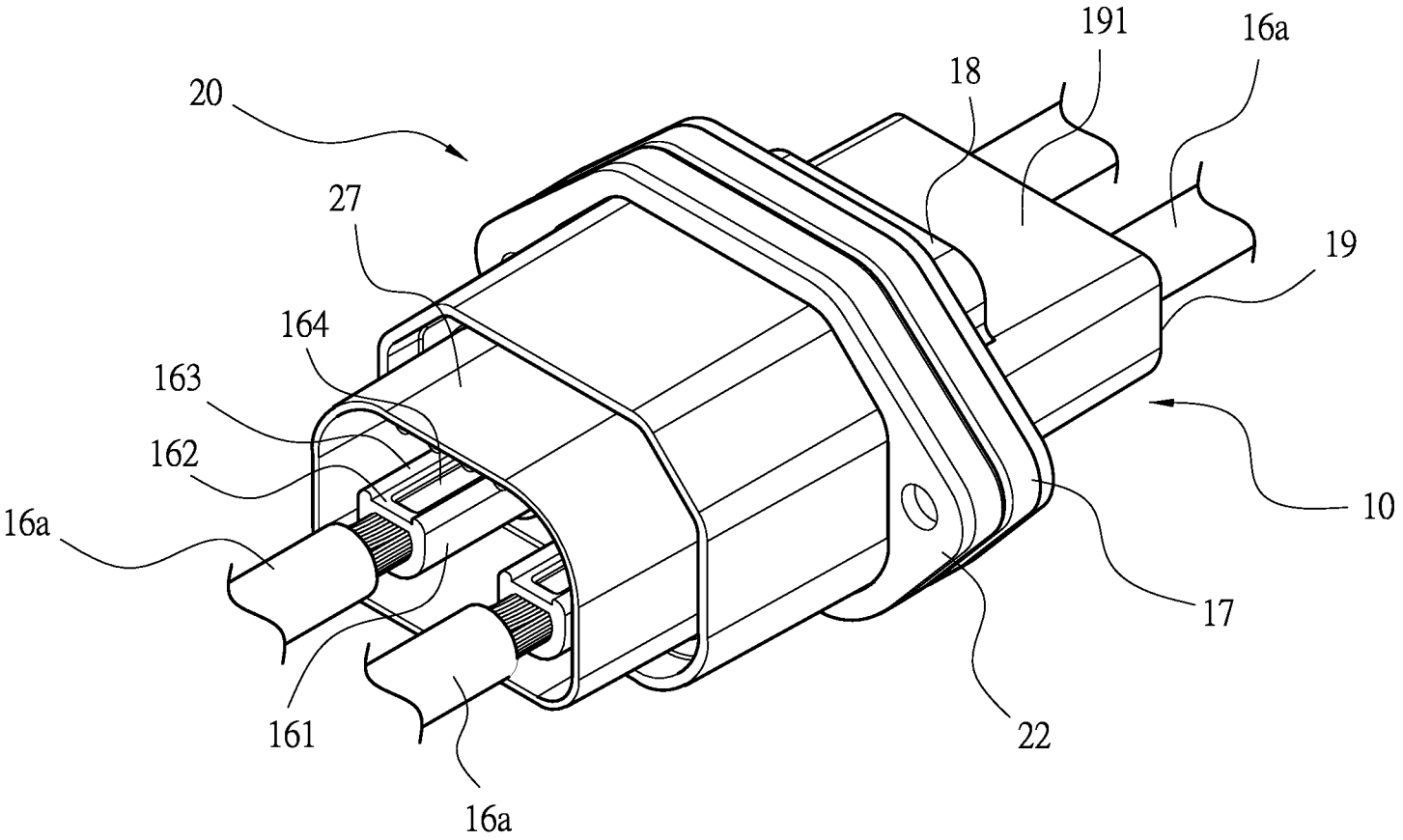
FIG. 1 is a perspective view of a preferred embodiment according to the present invention.

Please refer to FIG. 1 to FIG. 7. An electronic connector comprises: a male connecting member 10 and a female connecting member 20. The male connecting member 10 has a collar 11, and the collar 11 is jacketed with an elastic loop 12. The collar 11 further comprises a ring groove 112 at an outer surface, and the elastic loop 12 is disposed in the ring groove 112 for a positioning and sealing effect. Also, the collar 11 is provided with a first inner sidewall 111. The male connecting member 10 further has a signal unit 13 and a spacer 14 in the collar 11 arranged in a T-shape, and the signal unit 13 is provided with a plurality of signal pins 15. The male connecting member 10 has two elastic power poles 16 separated by the spacer 14. Furthermore, the signal unit 13 has a protrusion 131 facing the two elastic power poles 16, the spacer 14 has a pressing face 141 facing the signal pins 15, and the spacer 14 is provided with a guiding beveled edge 142 between pressing face 141 and the first inner sidewall 111. The male connecting member 10 further comprises a first assembling portion 17 at an outer bottom edge of the collar 11. The male connecting member 10 further comprises a signal connecting portion 18 and a power connecting portion 19 opposite to the collar 11. The end portions of the signal pins 15 are exposed from the signal connecting portion 18, and the end portions of the elastic power pole 16 are exposed from the power connecting portion 19. The power connecting portion 19 is provided with a flat surface 191 opposite the signal connecting portion 18, for storing an external cable. A female connecting member 20 has an outer ring 21 with a second assembling portion 22, and the outer ring 21 further has a signal socket 23 and two power sockets 24, which are electrically connected. The signal socket 23 has an elastic signal beam tube 25, and each of the power socket 24 has a power connecting tube 26. The signal socket 23 are the power socket 24 are not connected to the second inner sidewall 211, and a ducking slot 241 is disposed between the two power sockets 24. The signal socket 23 has a blocking face 231 towards the ducking slot 241. The collar 11 of the male connecting member 10 is insertable into the outer ring 21 of the female connecting member 20, and the signal socket 23 and the power socket 24 are disposed inside of the collar 21. The elastic loop 12 is curved and comprises a plurality of protruding rings 121, and the protruding rings 121 are disposed in the ring groove 112 for a positioning and sealing effect. The protruding ring 121 of the elastic loop 12 make contact with the second inner sidewall 221 of the outer ring 21. When the male connecting member 10 and the female connecting member 20 are engaged with each other, the elastic loop 12 is positioned by the ring groove 112 to secure the elastic loop 12. The number of the protruding rings 121 is 4 and each one is tapered, so the elastic loop 12 has sealing effect and water-proof effect. When the signal pin 15 and the elastic power pole 16 are respectively inserted into the elastic signal beam tube 25 and the power connecting tube 26, since an exposure height of the power socket 24 of the female connecting member 20 is greater than an exposure height of the signal socket 23, wherein the elastic power pole 16 is first inserted into the power connecting tube 26 to guild the signal pins to insert into the elastic signal beam tube 25. When the first assembling portion 17 and the second assembling portion 22 engage with each other, the first inner sidewall 111 of the collar 11 makes no contact with the signal socket 23 and the power socket 24, the second inner sidewall 211 of the outer ring 21 only makes contact with the elastic loop 12. Therefore, the second inner sidewall 211 makes no contact with the collar 11, a portion of the protrusion 131 of the signal unit 13 makes contact with the power socket 24, and a portion of the pressing face 141 of the spacer 14 pressing the blocking face 231 of the signal socket 23.

For the actual use of the effect, please refer to FIG. 1 to FIG. 7 again. The male connecting member 10 of the collar 11 is jacketed with the elastic loop 12, and the signal pin 15 is disposed through the signal unit 13 and the signal connecting portion 18. The elastic power pole 16 are placed inside the power connecting portion 19 and the collar 11, so that the spacer 14 separates the two power connecting portions 19. On the other hand, the female elastic signal beam tube 25 of connecting member 20 is placed through the signal socket 23, and the power connecting tube 26 is placed through the power socket 24. When the male connecting member 10 and the female connecting member 20 are plugged together, the collar 11 of the male connecting member 10 is inserted into the outer ring 21 of the female connecting member 20. At this time, the collar 11 and the outer ring 21 can be easily engaged because there is no any contact. After a proper insertion length, the spacer 14 is inserted in the ducking slot 241 with the help of the guiding beveled edge 142, the engagement of the spacer 14 and the ducking slot 241 prevents user from inserting into the wrong direction. In other words, the spacer 14 is blocked by the signal socket 23 of the female connecting member 20 at the first time, which prevent the signal pin 15 from being bent or broken due to the wrong direction insertion. When the male connecting member 10 is further inserted into the female connecting member 20, the elastic power pole 16 is directly inserted into the power connecting tube 26, the flexibility of the elastic power pole 16 provides a tight connection, and the elastic loop 12 contacts and slides along the second inner sidewall 211, which produces a moderate insertion resistance and guiding effect. When insertion length is increased, the signal pin 15 is aligned and inserted with the elastic signal beam tube 25, thereby with the guiding function of the elastic power pole 16, the male connecting member 10 and the female connecting member 20 can be accurately engaged. During the above-mentioned process, the first inner sidewall 111 of the collar 11 is not in contact with the signal socket 23 and the power socket 24, and the second inner sidewall 211 of the outer ring 21 is not in contact with the collar 11. There is no contact resistance among the collar 11, the outer ring 21, the signal unit 13, the spacer 14, the signal socket 23 and the power socket 24, therefore, an easy insertion can be achieved without affecting the engaging process. During a final stage of the insertion, the pressing surface 141 of the spacer 14 partially presses against the blocking face 231 of the signal socket 23, and the protruding 131 of the signal unit 13 partially pushes the power socket 24. In summary, after completing the male connection member 10 and the female connecting member 20, the elastic power pole 16 of the male connecting member 10 is deformed in the power connecting tube 26 of the female connecting member 20, and the elastic signal beam tube 25 can be sleeved outside the signal pin 15 to form an elastic deformation. The elastic loop 12 can also be sandwiched between the outer ring 21 and the collar 11 to form deformation of the protruding ring 121, to provide the maximum swinging and vibrating space of connection between the male connecting member 10 and the female connecting member 20. The swinging and vibrating space is partially pressed against the blocking face 231 through the pressing surface 141, and the protruding socket 131 partially touches the power socket 24, thereby forming a three-point solid contacts between the male connecting member 10 and the female connecting member 20. Therefore, the male connecting member 10 and the female connecting member 20 are able to minimize the amplitude of vibration or swing at the three-point hard contact position without completely preventing the swing or vibration between the connecting member 10 and the female connecting member 20. Also, it allows the male connecting member 10 and the female connecting member 20 to perform a slight swing or vibration subjected to external forces, so as to eliminate impact caused by external forces and protect the signal pins 15.

Figure 2:
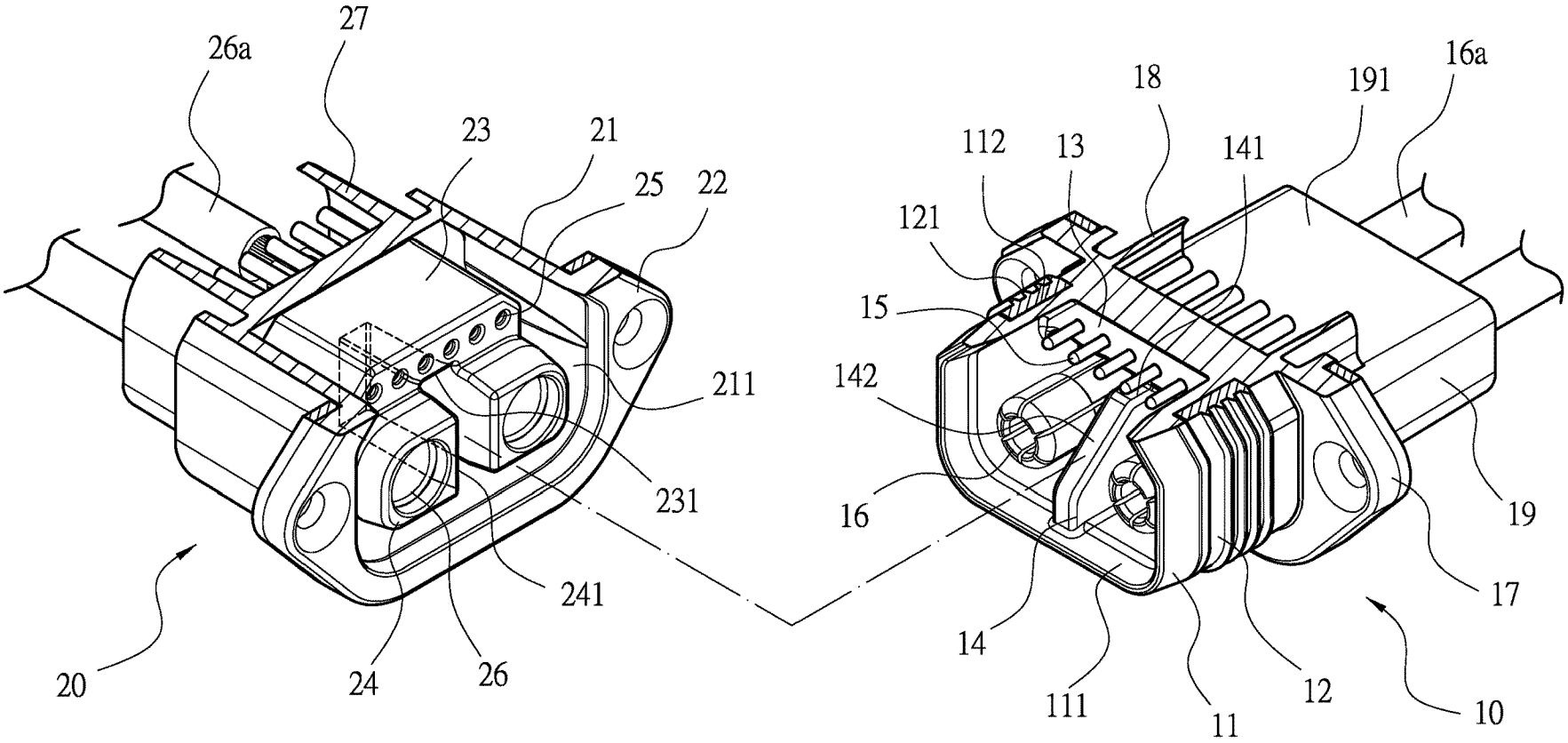
FIG. 2 is a three-dimensional exploded view of the preferred embodiment according to the present invention.
Figure 3:
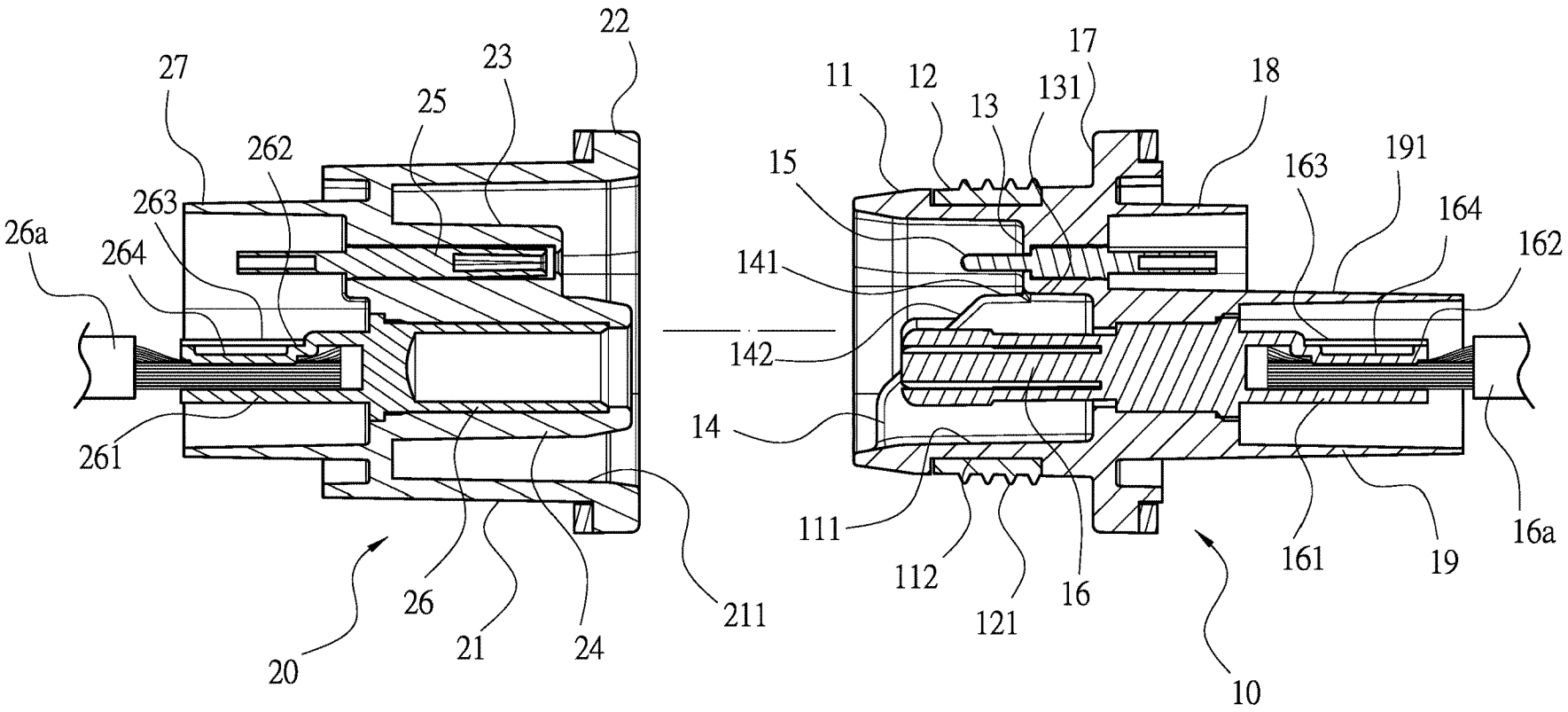
FIG. 3 is a cross-sectional exploded view of the preferred embodiment according to the present invention.
Figure 4:
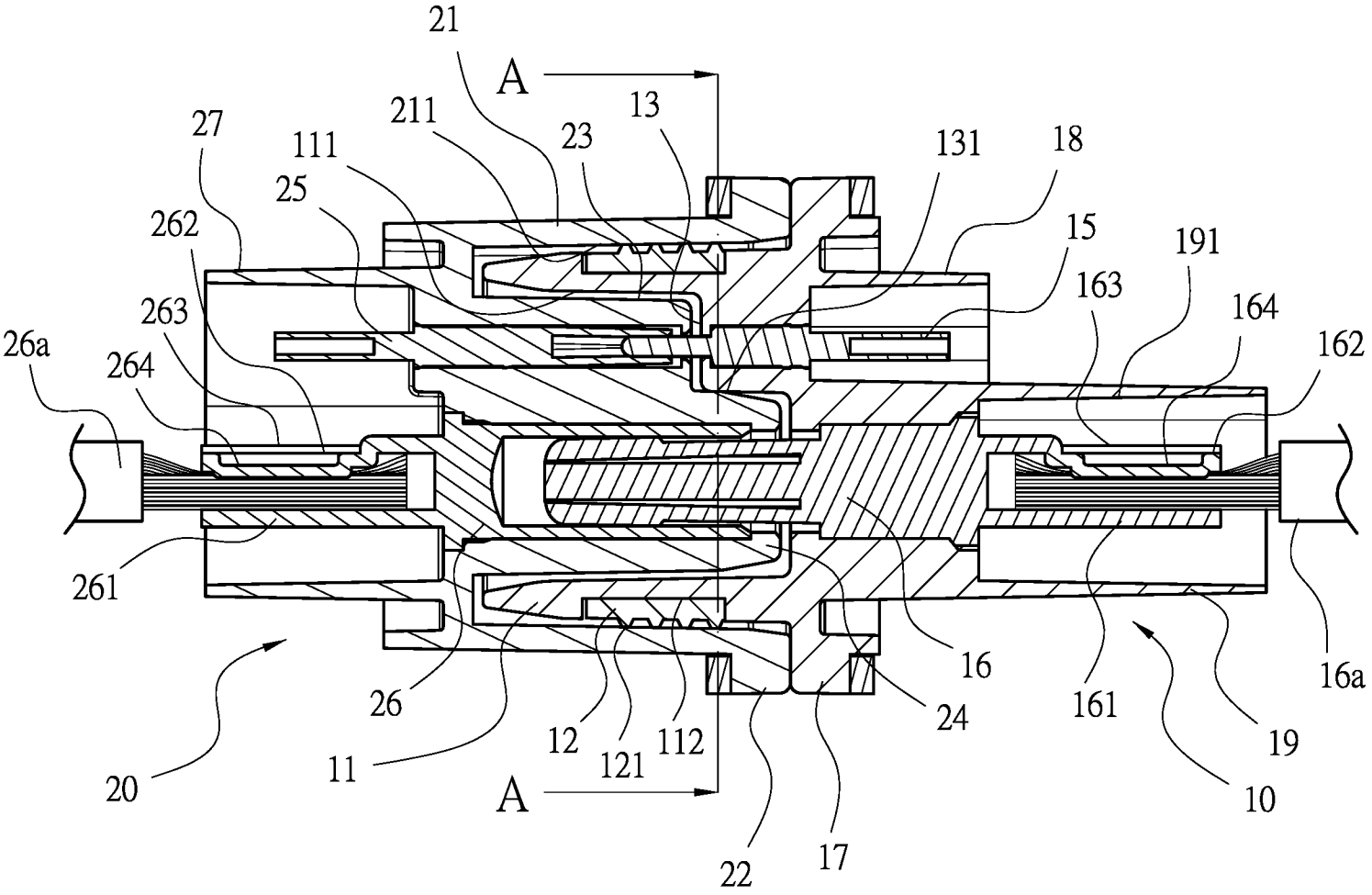
FIG. 4 is a cross-sectional view of the preferred embodiment till the elastic power pole according to the present invention.
Figure 5:
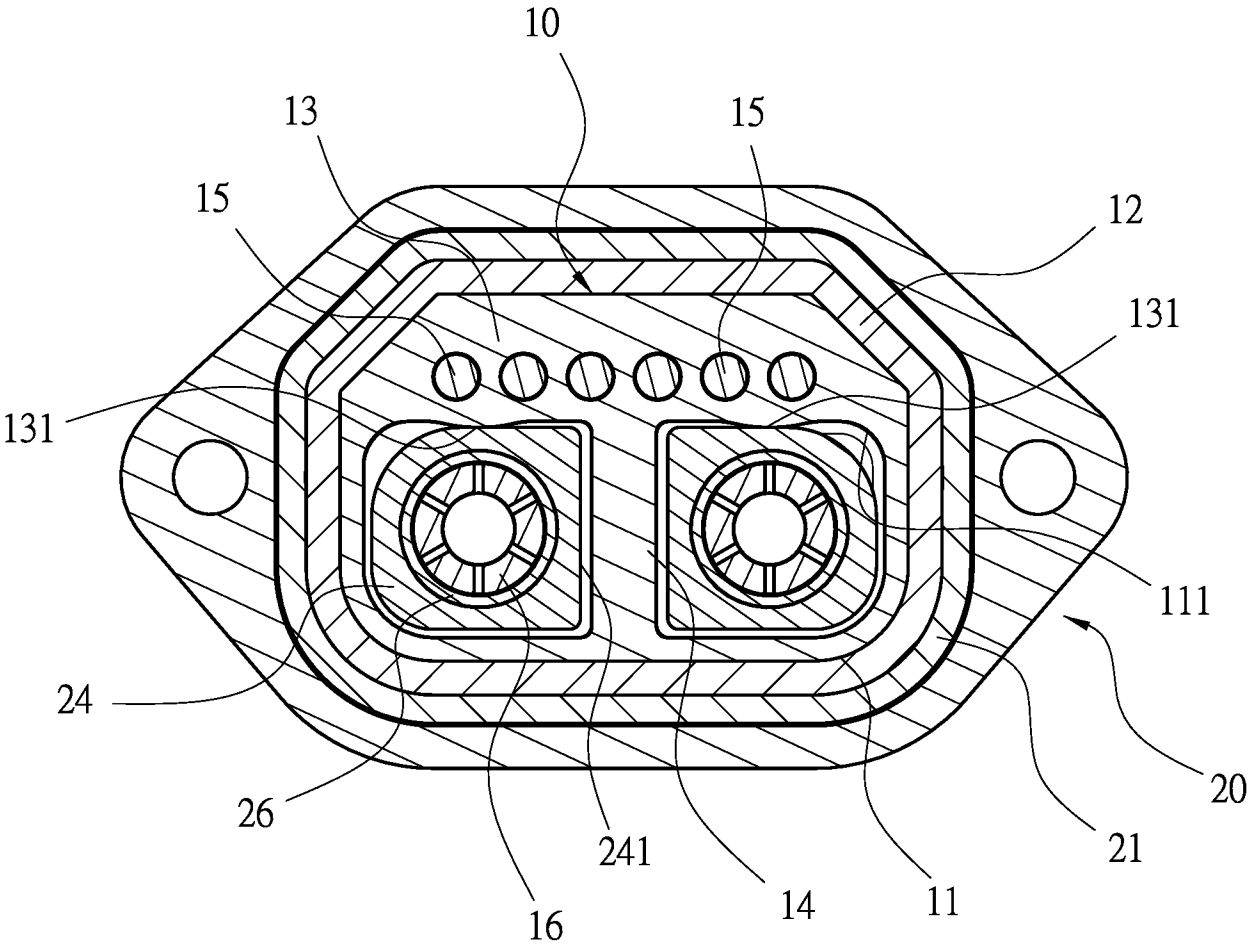
FIG. 5 is a cross-sectional view along the A-A line in FIG. 4.
Figure 6:
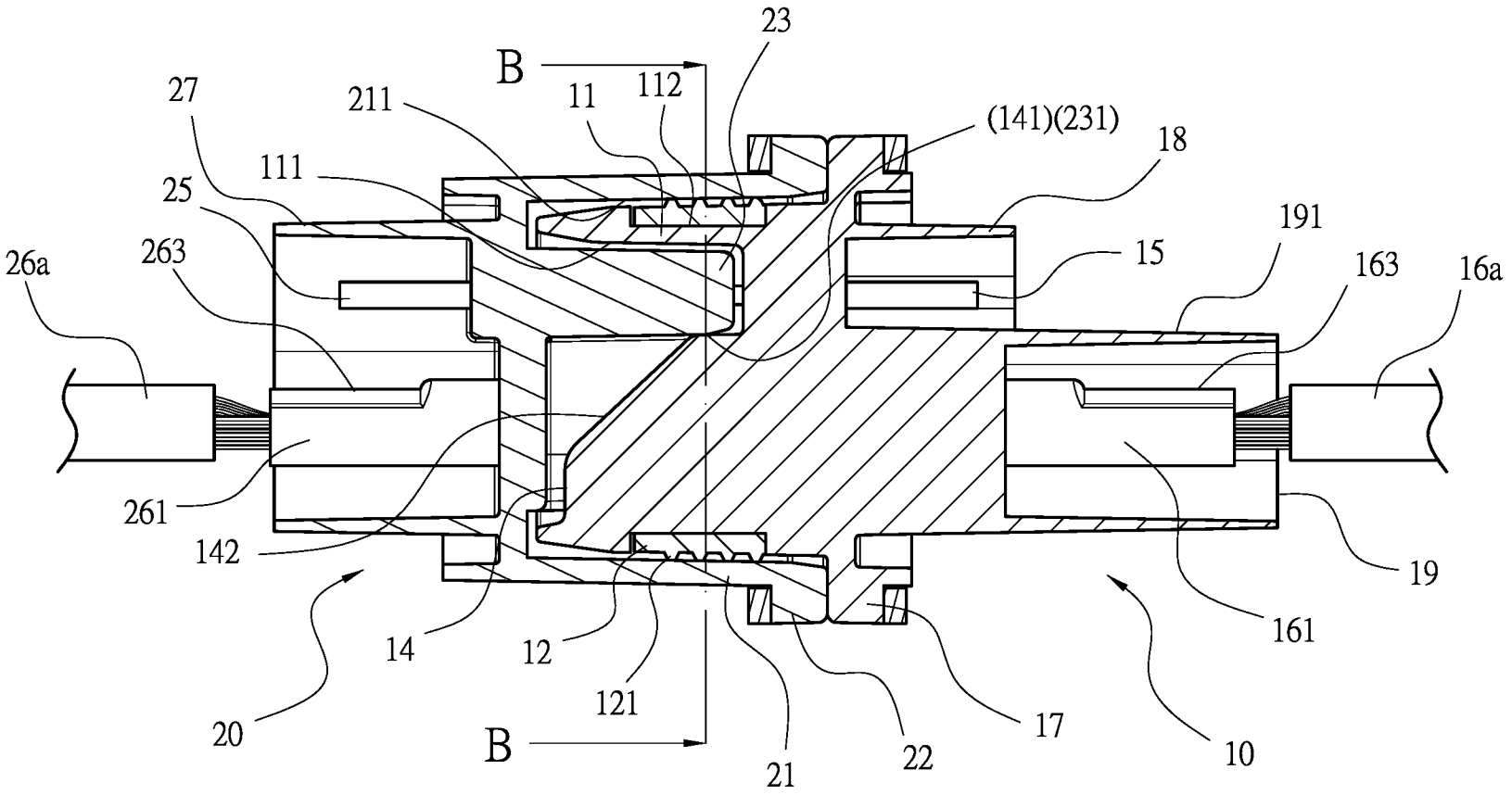
FIG. 6 is a partial cross-sectional view of the preferred embodiment according to the present invention.
Figure 7:
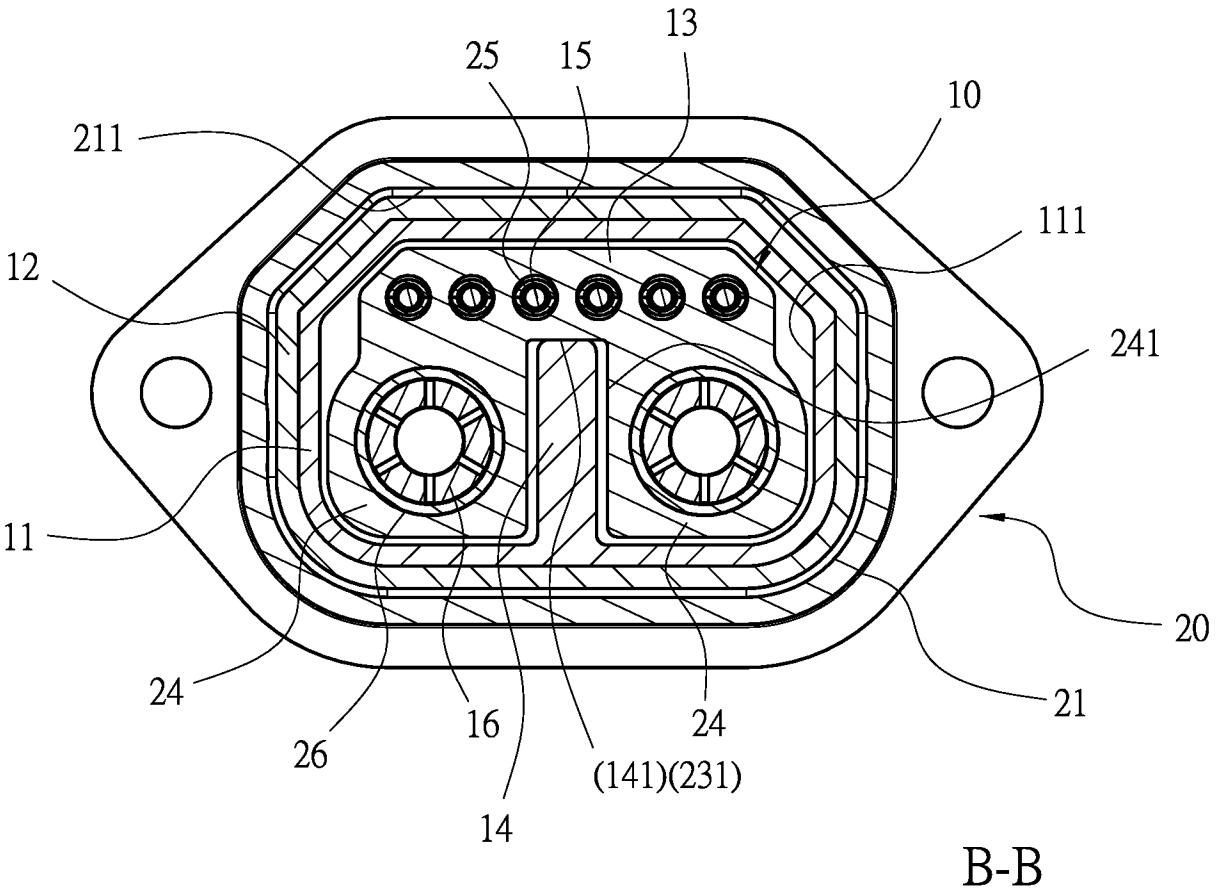
FIG. 7 is another cross-sectional view of the B-B line in FIG. 6.
Figure 8:
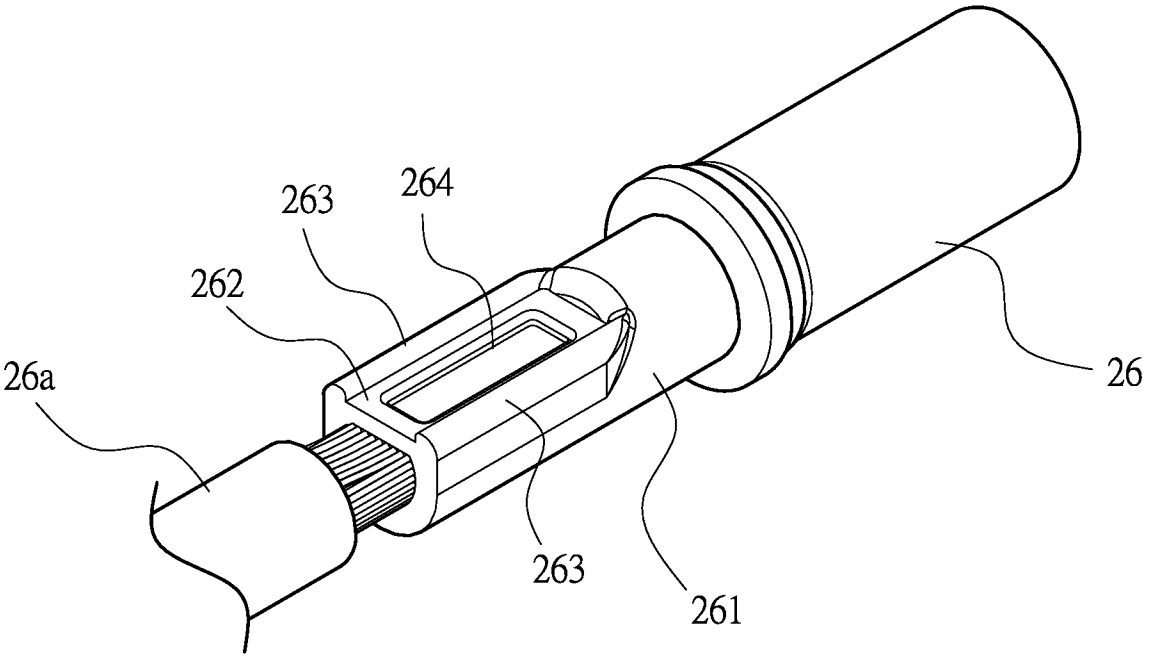
FIG. 8 is a perspective view showing the cable insertion of the preferred embodiment according to the present invention.

For further explanation, please refer to FIGS. 2, 3 and 8. The male connecting member 10 comprises a power connecting portion 19 opposite to the collar 10, and the elastic power pole 16 further comprises a wire sleeve 161 at the power connecting portion 19. The wire sleeve has a positive wiring harness 16*a* and is provided with a first indentation 162 on a side which squeezes the positive wiring harness 16*a*. The female connecting member 20 further comprises a female connecting portion 27 opposite the outer ring 21. The power connecting 26 tube further comprises a wire connecting tube 261 at the female connecting portion 27, the wire connecting tube 261 further comprising a negative wiring harness 26*a*, and the wire connecting tube 261 is provided with a third indentation 262 on one side for squeezing the negative wiring harness 26*a*. The wire sleeve 161 is connected to the positive wiring harness 16*a* and the wire connecting tube 261 is connected to the negative wiring harness 26*a*.

In the preferred specific embodiment, as shown in FIGS. 2, 3 and 8, the first indentation 162 of the elastic power pole 16 and the third indentation 262 of the power connecting tube 26 are both either square or rectangular and have two symmetrical edges as two ridges 163, 263. The two ridges 163, 263 are located on the weakest positions of the wire sleeve 161 and the wire connecting tube 261, thereby reducing the deformation at this position by the ridges 163, 263, and then effectively increasing the maximum allowable deformation. The wire sleeve 161 is further provided with a second indentation 164 at a center position of the first indentation 162 for further lowing a flow resistance between the wire sleeve 161 and the position wiring harness 16*a* within the allowable deformation amount. In addition, the third indentation 262 of the wire connecting tube 261 is provided with a fourth indentation 264 on one side for further squeezing the negative wiring harness 26*a*, for further lowing a flow resistance between the wire connecting tube 261 and the negative wiring harness 26*a* and squeeze the negative wiring harness 26*a* through the indentation of the fourth indentation 264, thereby further reducing the flow resistance between the wire connecting tube 261 and the negative wiring harness 26*a* within the allowable deformation. The second indentation 164 and the fourth indentation 264 are square or rectangular, the second indentation 164 is formed at the center of the first indentation 162, and the edge of the second indentation 164 and the edge of the first indentation 162 are properly spaced. The fourth indentation 264 is formed is at the center of the third indentation 262, and the edge of the fourth indentation 264 and the edge of the third indentation 262 are also properly spaced. Therefore, the second indentation 164 and the fourth indentation 264 are not subject to the maximum allowable deformation, which can effectively improve the compressing effect on the positive wiring harness 16*a* and the negative wiring harness 26*a*. Finally, through the tensile test and the current heating test, the second indentation 164 and the fourth indentation 264 can significantly improve the tensile strength under higher current, so that it can be applied to high current working environment under the same size specifications and material conditions.

Although the present invention has been explained in relation to its preferred embodiment, it is to be understood that many other possible modifications and variations can be made without departing from the spirit and scope of invention as hereinafter claimed.

What is claimed is:

1. An electronic connector comprising:

a male connecting member having a collar jacketed with an elastic loop and provided with a first inner sidewall, the male connecting member further having a signal unit and a spacer in the collar arranged in a T-shape; the signal unit provided with a plurality of signal pins; the male connecting member having two elastic power poles separated by the spacer; the signal unit having a protrusion facing the two elastic power poles and the spacer having a pressing face facing the signal pins;

a female connecting member having an outer ring with a second inner sidewall, the outer ring further having a signal socket and two power sockets, the signal socket having an elastic signal beam tube, each of the power sockets having a power connecting tube, the signal socket and the power socket not connected to the second inner sidewall, a ducking slot disposed between the two power sockets, the signal socket having a blocking face towards the ducking slot; the collar of the male connecting member insertable into the outer ring of the female connecting member, the signal socket and the power socket disposed inside of the collar, the signal pin and the elastic power pole respectively insertable into the elastic signal beam tube and the power connecting tube; the first inner sidewall of the collar making no contact with the signal socket and the power socket; the second inner sidewall of the outer ring only making contact with the elastic loop; a portion of the protrusion of the signal unit making contact with the power socket, a portion of the pressing face of the spacer pressing the blocking face of the signal socket.

2. The electronic connector as claimed in claim 1, wherein the male connecting member further comprises a first assembling portion at an outer bottom edge of the collar, the female connecting member further comprises a second assembling portion at an outer edge of the outer ring, and the first assembling portion and the second assembling portion engage with each other.

3. The electronic connector as claimed in claim 1, wherein an exposure height of the power socket of the female connecting member is greater than an exposure height of the signal socket, wherein the elastic power pole is first inserted into the power connecting tube to guild the signal pins to insert into the elastic signal beam tube.

4. The electronic connector as claimed in claim 1, wherein the elastic loop is curved and comprises a plurality of protruding rings, and the protruding rings make contact with the second inner sidewall of the outer ring.

5. The electronic connector as claimed in claim 4, wherein the collar further comprises a ring groove at an outer surface, and the elastic loop is disposed in the ring groove for a positioning and sealing effect.

6. The electronic connector as claimed in claim 1, wherein the male connecting member further comprises a power connecting portion opposite to the collar, the elastic power pole further comprising a wire sleeve at the power connecting portion, the wire sleeve having a positive wiring harness and provided with a first indentation on a side which squeezes the positive wiring harness.

7. The electronic connector as claimed in claim 6, wherein the wire sleeve is further provided with a second indentation at a center position of the first indentation for further lowing a flow resistance between the wire sleeve and the positive wiring harness.

8. The electronic connector as claimed in claim 6, wherein the male connecting member further comprises a signal connecting portion opposite the collar, end portions of the signal pins exposed from the signal connecting portion, and the power connecting portion is provided with a flat surface opposite the signal connecting portion, for storing an external cable.

9. The electronic connector as claimed in claim 1, wherein the female connecting member further comprises a female connecting portion opposite the outer ring, the power connecting tube further comprises a wire connecting tube at the female connecting portion, the wire connecting tube further comprising a negative wiring harness, and the wire connecting tube is provided with a third indentation on one side for squeezing the negative wiring harness.

10. The electronic connector as claimed in claim 9, wherein the third indentation of the wire connecting tube is provided with a fourth indentation on one side for further squeezing the negative wiring harness, for further lowing a flow resistance between the wire connecting tube and the negative wiring harness.

* * * * *